US009730296B2

(12) United States Patent
Griffiths et al.

(10) Patent No.: US 9,730,296 B2
(45) Date of Patent: Aug. 8, 2017

(54) SWITCH ACTUATED CIRCUITS

(75) Inventors: Bryn Griffiths, Hong Kong (HK); Jon Duncan, Middlesex (GB)

(73) Assignee: BENMORE VENTURES LIMITED, Tortola (VG)

( * ) Notice: Subject to any disclaimer, the term of this patent is extended or adjusted under 35 U.S.C. 154(b) by 397 days.

(21) Appl. No.: 13/514,452

(22) PCT Filed: Dec. 13, 2010

(86) PCT No.: PCT/GB2010/002266
§ 371 (c)(1),
(2), (4) Date: Jul. 3, 2012

(87) PCT Pub. No.: WO2011/070338
PCT Pub. Date: Jun. 16, 2011

(65) Prior Publication Data

US 2012/0268018 A1 Oct. 25, 2012

(30) Foreign Application Priority Data

Dec. 11, 2009 (GB) ..... 0921749.8
Jun. 3, 2010 (GB) ..... 1009333.4

(51) Int. Cl.
*H05B 37/02* (2006.01)
*H05B 33/08* (2006.01)

(52) U.S. Cl.
CPC ..... *H05B 37/02* (2013.01); *H05B 33/0803* (2013.01); *H05B 33/0842* (2013.01)

(58) Field of Classification Search
CPC ..... H05B 37/02
USPC ..... 315/194, 312, 250, 299, 294, 132, 291, 315/287
See application file for complete search history.

(56) References Cited

U.S. PATENT DOCUMENTS 4,482,895 A * 11/1984 Weinberg ..... G08C 19/22 340/12.5
4,523,258 A * 6/1985 Morse et al. ..... 362/108
4,590,471 A 5/1986 Pieroway et al.
5,746,499 A * 5/1998 Ratcliffe ..... A43B 3/001 36/137

(Continued)

FOREIGN PATENT DOCUMENTS

FR 2 255 774 A1 7/1975
FR 2255774 A1 7/1975

(Continued)

OTHER PUBLICATIONS

Author: Microchip Technology Inc, Title:PIC12F683, Date:2007.*

(Continued)

*Primary Examiner* — Douglas W Owens
*Assistant Examiner* — Wei Chan
(74) *Attorney, Agent, or Firm* — Thomas I Horstemeyer, LLP

(57) ABSTRACT

A trigger circuit (10) comprises a switch member (SW1) connected in series with a high-ohmic resistive element (R1), the junction between the switch member and the resistor element being connected via a capacitor (C1) to the input of a circuit (20) to be triggered. The circuit (20) operates a light-emitting source (130, FIG. 3). The switch (SW1) can be a user-operated switch, a tilt switch (100, FIG. 2) or can be a comparator (124) responsive to an external factor e.g. incoming vibrations.

15 Claims, 2 Drawing Sheets

(56) References Cited

U.S. PATENT DOCUMENTS

| | | | | |
|---|---|---|---|---|
| 6,230,276 | B1 * | 5/2001 | Hayden | G01R 1/20 713/320 |
| 7,108,389 | B1 | 9/2006 | Fu | |
| 7,202,613 | B2 * | 4/2007 | Morgan et al. | 315/312 |
| 7,573,046 | B1 * | 8/2009 | Chubun | H01J 37/065 250/423 F |
| 7,583,031 | B1 * | 9/2009 | Sansone | H05B 37/034 315/132 |
| 8,134,303 | B2 * | 3/2012 | Lys | 315/291 |
| 8,198,822 | B2 * | 6/2012 | Byun et al. | 315/291 |
| 8,203,288 | B2 * | 6/2012 | Lee | 315/308 |
| 8,760,084 | B2 * | 6/2014 | Lin et al. | 315/307 |
| 2003/0028260 | A1 * | 2/2003 | Blackwell | 700/18 |
| 2003/0214808 | A1 | 11/2003 | Hauck | |
| 2004/0004829 | A1 * | 1/2004 | Policappelli | A47G 19/025 362/101 |
| 2005/0057188 | A1 * | 3/2005 | Wong | H05B 37/029 315/291 |
| 2005/0082989 | A1 * | 4/2005 | Jones et al. | 315/194 |
| 2007/0103099 | A1 | 5/2007 | Sotiriou | |
| 2007/0170876 | A1 | 7/2007 | Ito et al. | |
| 2008/0111685 | A1 * | 5/2008 | Olson | B65D 55/028 340/545.6 |
| 2008/0164826 | A1 * | 7/2008 | Lys | 315/250 |
| 2008/0211428 | A1 * | 9/2008 | Bayat et al. | 315/299 |
| 2008/0246416 | A1 * | 10/2008 | Jones et al. | 315/294 |
| 2009/0067159 | A1 * | 3/2009 | Beneski | A62B 35/0006 362/108 |
| 2009/0097236 | A1 * | 4/2009 | Miller et al. | 362/119 |
| 2009/0189548 | A1 | 7/2009 | Hoffman et al. | |
| 2009/0278707 | A1 * | 11/2009 | Biggins | A43B 1/0027 340/870.16 |
| 2009/0295300 | A1 * | 12/2009 | King | 315/209 R |
| 2010/0127634 | A1 * | 5/2010 | Dowling | H05B 37/02 315/291 |
| 2010/0194285 | A1 * | 8/2010 | Byun et al. | 315/125 |
| 2010/0259183 | A1 * | 10/2010 | Leshniak | H05B 33/0815 315/287 |
| 2010/0280511 | A1 * | 11/2010 | Rachlin et al. | 606/34 |

FOREIGN PATENT DOCUMENTS

| | | | |
|---|---|---|---|
| FR | 2 451 697 | A3 | 10/1980 |
| FR | 2451697 | A3 | 10/1980 |
| WO | 2004/110892 | A1 | 12/2004 |
| WO | 2010/055312 | A1 | 5/2010 |
| WO | 2011/007113 | A1 | 1/2011 |
| WO | 2011/070336 | A1 | 6/2011 |
| WO | 2011/070337 | A1 | 6/2011 |
| WO | 2011/070338 | A1 | 6/2011 |

OTHER PUBLICATIONS

Title Elektor Electronics Magazine, Date: 2006, pp. 1-4, Author: Christian Tavernier.*

Title Elektor Electronics Magazine, Date: 2007, pp. 1-7, Author: Raj. K. Gorkhali.*

International Search Report dated Mar. 23, 2011.

* cited by examiner

SWITCH ACTUATED CIRCUITS

CROSS-REFERENCE TO RELATED APPLICATION

This application is a co-pending application which claims priority to PCT Application No. PCT/GB2010/002266, filed Dec. 13, 2010, entitled "Switch Actuated Circuits" herein incorporated by reference in its entirety. This application also claims priority to, and the benefit of, Great Britain Patent Application 1009333.4, filed Jun. 3, 2010, and Great Britain Patent Application No. 0921749.8, filing date Dec. 11, 2009, both of which are herein incorporated by reference in their entireties.

The present invention relates to switch actuated circuits. There are known such circuits for illumination devices for attaching to containers, e.g. to illuminate the contents of the containers upon actuation of a switch. For example WO 2004/110892 discloses labels for attaching to bottles and incorporating switchable illumination devices. Co-pending applications PCT/GB2009/002097 and PCT/GB2009/002676 also disclose devices for attaching to the walls of containers.

Such devices are typically powered by one or more battery cells which are relatively small and thus have a relatively short lifetime unless their power is conserved. A problem with some existing illumination devices is that a switch, if left closed, may prevent the circuit from correctly entering the standby mode. For example, due to inadvertence, a user-operated switch may be left on when not required. Alternatively, a switch which normally acts in a substantially momentary fashion may not operate correctly and may remain "on" instead of quickly reverting to an "off" condition.

Aspects of the present invention seek to overcome or reduce one or more of the above problems.

With a first group of ICs, the standby configuration cannot be entered if the triggering switch remains on. With a second group of ICs, this problem does not arise at a first operating voltage but does occur at a second, higher operating voltage.

A particular aim of battery-powered light-emitting devices is to obtain as bright a display as possible without running down the batteries too quickly. Thus if one uses a higher operating voltage with a view to increasing brightness in a circuit employing ICs within the second group, there is an increased risk of failure to enter the standby mode when desired.

Another way of increasing the brightness of a light-emitting device is to increase the packing density of the light emitting devices on a circuit board. The method of assembly and physical configuration of bonded LEDs, for example, impose physical limits on how closely they can be disposed on a circuit board.

According to the present invention, there is provided a circuit for triggering operation of a device, and a switch member for actuating the circuit, wherein the switch member is connected in series with a high-ohmic resistive element, and wherein a junction between the switch member and the resistive element is connected via a capacitor to the input of the operating circuit.

The switch member may be of various types, and the circuit is particularly suitable for switches which are more likely to be left in an "on" condition after actuation. An example of such a switch is a tilt switch.

Alternatively, the switch member may be a comparator. In a preferred embodiment, the comparator switches in response to a passive piezoelectric sensor device detecting incoming vibrations.

Although other types of light sources may be employed, the device preferably employs at least one LED device as a light source.

The LED device is preferably a surface mount LED device. This permits an easier method of assembly and permits a brighter display to be provided.

Preferred embodiments of the present invention will now be described, by way of example only with reference to the accompanying drawings, of which:

Figure 1:
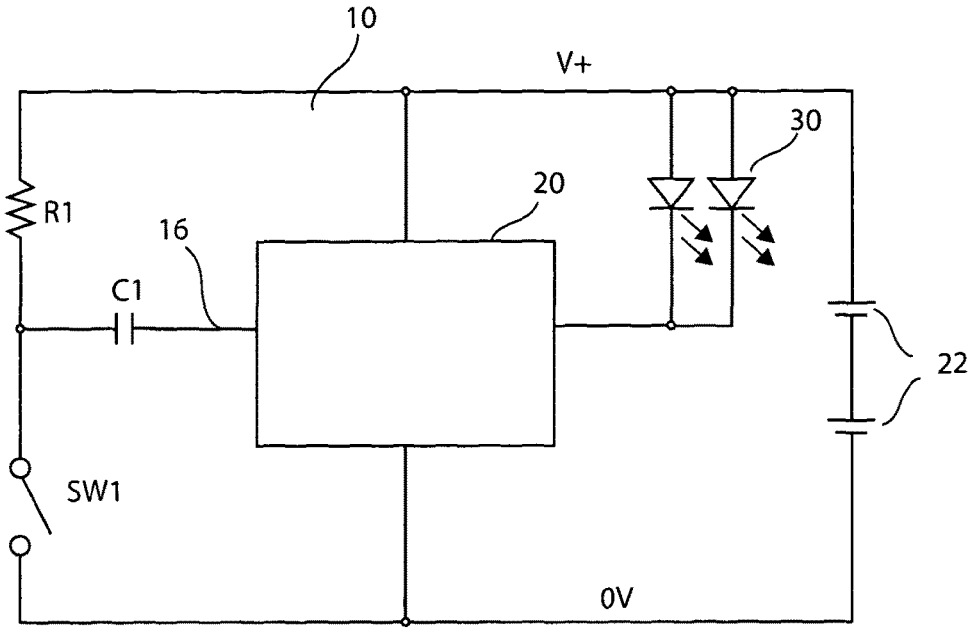
FIG. 1 is a circuit diagram of a switch arrangement in accordance with a first embodiment of the present invention for an illumination device.

Referring to the drawings, FIG. 1 shows a switch arrangement 10 for triggering the input 16 of an integrated circuit 20 of a device including at least one LED light source 30. The LED may be a bonded LED but is preferably a surface mount LED. The arrangement comprises a switch SW1 connected in series with a high value resistor R1 between voltage rails at OV and V+. The voltage rails are connected to respective terminals of a series connection of two 3V lithium battery cells 22.

Different switch types may be used to actuate an LED control IC. This includes tilt switches, slide switches and tactile push switches. Other circuits may also be used to trigger LED control ICs. For example, in a vibration actuation device, a comparator is used to trigger the LED control IC when the comparator output changes state. In particular the IC can be triggered by the use of different sensors, with or without an interface circuit to such a trigger input. Such sensors may include motion sensors such as inertial switches, vibration sensors such as passive piezoelectric sensors, temperature sensors such as PTCs, NTCs or IR sensors, magnetic sensors such as Hall-effect devices, wireless sensors such as radio frequency receivers, electromagnetic sensors such as LDRs or photo-diodes, light sensors, sound sensors such as electret condenser microphones, moisture sensors, proximity sensors, pressure sensors, manual switching, direct circuit interfacing, etc. The illumination effect can be made time variable so the effect lasts for or starts after a specified period of time. It is possible to implement more than one type of sensor simultaneously.

Tilt switches contain small ball bearings which roll inside a chamber. When they make contact with a contact point at the end of the chamber a connection is made from that contact to the body of the chamber as the end contact, bearing and body are all conductive. The position of the bearings can be unpredictable within the chamber and they may remain in the contact position even when the switch is not being tilted. Thus the contact may remain closed. If a slide switch is used, which is manually positioned, the switch may not be repositioned to the normal off position. If a tactile push switch is used it is possible that accidental pressure or a slightly damaged switch may cause its contacts to remain closed. In addition a comparator output may be settled in an unpredictable high or low state. Either state can be equivalent to a mechanical switch being closed depending on the circuit arrangement.

In all of the above cases if the switch is interfaced directly to the trigger input of common LED flashing or LED pulsing or other LED effect ICs, then that trigger input remains connected. Since these trigger inputs only require a momentary contact to be made for a fraction of a second, the switch must be opened and then closed again for another trigger to occur. If such a trigger is not momentary, then generally the major operation of the IC is unaffected and a timed function will still be timed correctly and the effect can stop as required. Then the opening and closing of the trigger switch will cause the required re-trigger.

While the IC is waiting for a re-trigger it enters a standby state. These standby states are useful in that they are designed to minimise any current draw required. This allows such ICs to be used in battery powered devices since they drain very little current from the battery while waiting to be triggered. It is common for such standby states to draw a current in the order of 1 μA. However, with many such ICs, if the trigger input remains connected because the trigger switch has remained closed, then the required standby current of 1 μA cannot be achieved and has been found to rise to as much as 300-400 μA. Thus the desired standby currents are not achievable when the trigger input still has a DC current path into it or out of it.

Thus in FIG. 1, SW1 represents any of the above types of switch, i.e. a mechanical switch or any other circuit device or arrangement which normally causes the trigger input 16 to be connected to the OV potential. The junction between switch SW1 and resistor R1 is connected to input 16 via a capacitor C1 which is effective in removing the DC path to the trigger input.

When SW1 is closed, the trigger input is momentarily forced to OV as the charge on the capacitor C1 changes. SW1 can thereafter remain closed with no adverse affect on the circuit operation. R1 is selected to be of a high value so the additional drain through R1 is not significant. For a re-trigger to occur, SW1 will need to re-open and close again, but this is a requirement in any case. When the switch is open, the charge on C1 re-balances through R1. The values of R1 and C1 are chosen to suit the timing requirements of the trigger input. For example R1 is typically between 2 and 8 megaohms preferably 4.7 megaohms and C1 is typically between 5 and 20 nF preferably 10 nF.

An advantage of the above described arrangement is that, with the addition of only a few circuit components, the DC path to the trigger input 16 is removed. The switch SW1 can remain closed and yet the integrated circuit 20 is still capable of correctly entering the low current standby state. Thus the circuit resolves the issue of incorrect or out of specification standby currents caused by the trigger inputs remaining connected.

Although some ICs do not exhibit any failing in their ability to correctly enter standby under "normal" circumstances, there is a proportion of these which can fail in respect of their standby currents being out of specification under certain operating conditions. In arrangements in accordance with the present invention, the ICs are preferably run from a 6V power source such as the battery cells 22. Such a voltage enables higher LED output illumination levels to be obtained. For the above-mentioned proportion of ICs, this can be above their normal operating voltage range, which may be typically around 4.5V. This increased voltage can afford the ability of the IC to enter standby correctly when the trigger switch input remains closed.

Again, the advantage of the above-described arrangement is such that, with the addition of a few components, the DC path to the trigger input is removed and the failure of the IC to correctly enter standby is circumvented, and correct low current standby can be achieved.

In a modification, if the trigger input is to be connected to V+, the trigger circuit arrangement can be simply inverted.

In another modification the circuit 20 is used to produce an audio output in addition to or instead of a light output.

The circuit 20 can be part of a device which is attached to a bottle, a cigarette packet, an ashtray, a cornflake packet or containers of toothpaste, cosmetics, foodstuffs etc. The device can be attached to the wall of a room, e.g. inside a night club.

A preferred way of triggering an illumination effect could be by using a tilt switch/motion sensor such that when the bottle is picked up to be poured the motion sensor activates the illumination effect(s) either simultaneously or separately. However other sensors could also be utilised as disclosed above. In certain instances, it may be advantageous to have an initial activating event (for example, removal of a pull-tab), coupled with a light sensor such that the light sensor shuts down the device, for example, during transit or storage of the product to prevent unintended activation. This would allow the device to be pre-activated in advance of it reaching its end use destination. Here, therefore, there would be no need for third party interaction for activating the unit. Such an arrangement is disclosed in our co-pending international application filed on even date and entitled "Switch-Actuated Arrangements".

Figure 2:
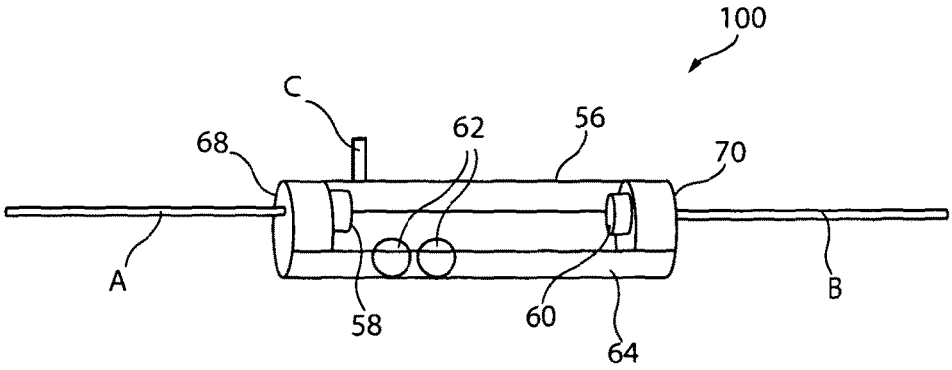
FIG. 2 is a perspective view of a tilt switch used in embodiments of the present invention.

FIG. 2 shows a tilt switch 100 which may be used with the embodiment of FIG. 1. The switch comprises a generally cylindrical conductive casing 56 with end contacts 58, 60 respectively connected to terminal wires A and B. Thus the switch is a double-ended switch. The end contacts are respectively mounted within insulating ends 68, 70. The casing has a terminal contact C. Casing 56 contains two conductive balls 62. In addition, casing 56 has on its inner surface an insulating layer or strip 64 which extends from end to end and around half of the circumference of the casing (the bottom half as shown in FIG. 6). Thus whatever the positions of the balls 62 along the length of switch 100, they are unable to complete any circuit while they are rolling on insulating strip 64.

To further ensure that undesired contact between balls 62 and conductive casing 56 is prevented, it is arranged that end contacts 58, 60 are radially offset away from insulating strip 64 and that balls 62 are of a size such that they do not touch contacts 58, 60 while rolling on the insulating strip.

Tilt switch 100 is particularly useful when an article to which a light source or other electrical component is attached can be disposed upside down when the light effect is not required. For example, it can be arranged that both during transport and during storage before use, the tilt switch 100 is disposed with the insulating strip 64 at the bottom. This can be arranged by the configuration of the packaging of the relevant article to which it is attached. This ensures that, with the insulating strip 64 at the bottom, the battery is not drained even when the switch is tilted from side to side or subjected to vibrations. When the light or other effect is required, switch 100 is inverted so that strip 64 is at the top, and the switch behaves like a normal tilt switch. Thus, in effect, switch 100 can function as two switches.

In a modification, the end contacts 58, 60 are not radially offset, the insulating strip 64 alone being relied on to provide the required function.

In an alternative modification, the insulating strip 64 is omitted, the offset position of the end contacts 58, 60 combined with the small diameter of balls 62 being relied on to provide the required function.

Various additional modifications can be made. For example, one of the end contacts may be disposed centrally of its end while the other one is disposed radially offset. A large ball 62 may be arranged to engage the central contact and a smaller ball 62 may be arranged to selectively engage the offset contact.

Although the strip 64 has been disclosed as extending around half of the circumference of the casing (i.e. 180°) it may extend around a greater or lesser extent, e.g. between 90° and 270°. Moreover, the ends of the strip can be circumferentially offset so that different orientations of the device are required for the respective end contacts 58, 60 to be effective. The circumferentially offset nature of the ends of the strip can be obtained by configuring the strip spirally on the casing; alternatively, or in addition, an insulating layer may be provided in two or more separate pieces.

Figure 3:
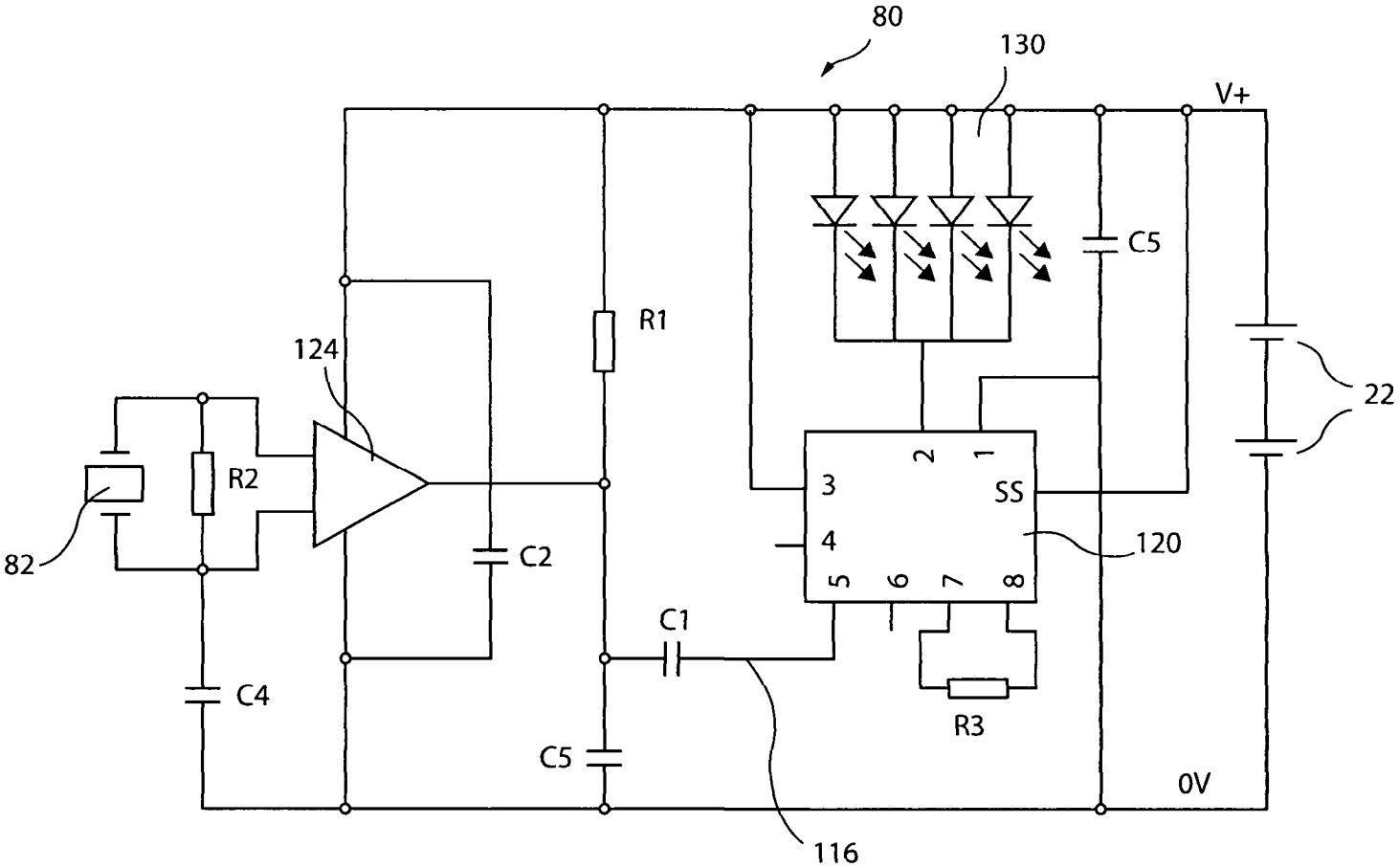
FIG. 3 is a circuit diagram of a circuit in accordance with a second embodiment of the present invention.

A second embodiment of the present invention is shown in FIG. 3 and provides a vibration sensing version of the illumination device.

Vibration sensing can be achieved by using a passive piezoelectric sensor 82 as the input to circuit 80. This is interfaced with an IC trigger input 116 of an integrated circuit 120 via, a low power comparator 124 which is connected between the piezoelectric sensor and the trigger input. This ensures that the trigger input only receives the required voltage levels. In addition, since comparators are available with very low current requirements, this combination creates the equivalent of an active sensor with very low power drain. This combination can be used for sensing the dispensing of a measure of liquid from an optics dispenser, for example. It can also be used for sensing the movement of products on a supermarket shelf. The sensitivity of this combination may be tailored for specific requirements. The circuit is powered by any convenient power source, for example two 3 volt lithium batteries 22.

Such a device variant is typically attached to the base of a spirits bottle. When the bottle is then clamped into a standard optics dispensing unit, the device activates when a drinking glass is pressed up against the optics drink dispensing mechanism. This is achieved because the device located in the base of the bottle is able to detect the small vibrations in the glass body of the bottle that are caused by a drinking glass pressing up against the drink dispensing mechanism in the bottle neck.

The vibration sensing device responds to 'the activity' of dispensing a measure from a spirits bottle—in other words when a glass is pressed against the optic dispensing unit and a drink flows into the glass an event is triggered in the device e.g. a preset illumination effect and colour. The illumination is provided by a plurality of LED devices 130, in particular surface mount LED devices.

There are optics device units on the marketplace that have a built-in illumination source for illuminating the contents of bottles that are clamped into the device. They can illuminate the contents a range of different colours and utilise a variety of illumination effects. Typically these units are battery powered. There are a number of drawbacks to this approach. In order to illuminate the contents of a bottle, a bar would require this special optic device with a built-in illumination unit. The vibration sensing circuit 80, however, fits any type of optics device unit on the marketplace because it is completely independent of the optics device unit itself since it is attached directly the bottle rather than the optics device unit.

Also the vibration sensing device can be tailored to meet the needs of the bottle/brand e.g. the colour of the LEDs can be customised to suit the contents, as the effect type and the effect duration once triggered.

Brand owners are offered no competitive advantage if a bar utilises an optic device unit with a built-in illumination component. This is because any competitor bottle can fit into such a unit and be illuminated. A brand owner just wants their own product to be lit so that it is differentiated from competitors' brands. Because the vibration-sensing device comes attached to a label, it can be can be pre-applied by the brand owner to their own brand before it enters a bar thereby preventing bar staff from using the device on a competitor's brand. However if the device is applied on-premise by bar staff the fact that the vibration sensing device label can be specifically branded (printed with the product name and logo), this increases the likelihood that bar staff will attach the device to the brand owner's product rather than a competitor's product.

The vibration sensing device lasts for the lifetime of the contents being dispensed that is to say for the number of single or double measure 'pours' and/or the shelf life period that the product could remain attached to the bottle for and therefore the stand by requirement for the device e.g. 60 days. Using the standby current limiting circuitry in connection with FIG. 1, the vibration sensing device can be left on all the time once initially activated.

Other switching mechanisms could be used instead of a vibration sensing switch to illuminate the contents of optics bottles. These include using an on/off switch, using an active sensor such as a microphone, using a combination of a switch and wires running down optics device unit itself or even using a foot switch operated by a bar staff member when a drink is dispensed.

A variant of the vibration sensing device can be used for POS (point-of-sale) purposes and for on-shelf display purposes on shelving, for example in supermarkets. Here the ability to suddenly illuminate containers in the vicinity of a potential purchaser acts as an effective eye catching mechanism for influencing buyer behaviour and driving sales.

For example, a vibration sensing device attached to a bottle sitting on a supermarket shelf could illuminate the bottle contents when a shopper picks up the bottle to inspect it. This could cause the shopper to then purchase the product or draw the attention of other shoppers nearby towards the product.

Alternatively, a competitor product sitting adjacent to the product on a shelf could be picked up by a shopper and the subsequent vibrations caused through the shelving of this action could trigger the contents illumination of the product to which the device is attached—this could dissuade the shopper from purchasing the competitor product in favour of the product to which the device is attached.

The vibrations caused through flooring of shoppers passing by the shelving to which the product containing the device is sitting could also trigger the device.

Alternatively, if the product fitted with the device was in a refrigerator cabinet of a supermarket, bar, club or even in the home, the opening of the refrigerator door could cause sufficient vibrations to trigger contents illumination and thereby influence the purchasing or consumption decision.

Another variation could involve a bottle to which the device is attached simply sitting on a bar shelf. Any movement of the shelf, e.g. from competitor brands being picked up and used by bartenders, ice buckets being moved, tills being rung up etc. could trigger contents illumination and draw consumers' attention towards the product.

Another variant could be utilised to enhance the in-home drinking experience, for example at parties, where drinks bottles fitted with the device could illuminate the container contents when the bottle is picked up or disturbed.

In certain instances, it is advantageous to have an initial activating event (for example, removal of a pull-tab), coupled with a light sensor such that the light sensor shuts down the device, for example during transit or storage of the product, to prevent unintended activation. This allows the device to be pre-activated in advance of it reaching its end use destination. Here, therefore, there would be no need for intervention by a user such as a member of the buying public or a bartender for actuating the unit.

As mentioned above, surface mount LED devices are preferably used as light sources, since they have a number of advantages over other light sources including bonded LEDs.

Bonding LEDs is a partially manual process. A machine is used, which has coordinates programmed into it, in order to add bonding wires. This machine is under some manual control for the decision to bond each point. Resin is then applied manually to cover the mounted LED, typically in a dome shape. A problem with this application of resin is that it can spread over a relatively large surrounding area, and thus may encroach into spaces provided for other components or onto pad areas which are later required for the hand soldering of other components. This may impose design constraints so that one is prevented from using the best components for a specific design, because the components cannot fit into the available space. Lack of space also means that compromises in the positioning of the LEDs may have to be made, even at the design stage.

Spreading of the resin may also overlap the area for cell insertion, so that a battery cell may be undesirably lifted away from an underlying printed circuit board by even small amounts of hardened resin. This can produce malfunctioning of the device due to intermittent battery connections. Sometimes the resin encroachment into the battery areas means one cannot push the battery under the battery clip.

When a bonded LED and its resin are placed very close to a pad which requires hand soldering, it becomes possible for a worker to accidentally burn the resin, altering its light dispersion and light output and sometimes the colour of light becomes tinted by discoloured resin.)

Since SMD (Surface Mount Devices) LEDs are relatively small compared to the area used for bonded LEDs and other light-emitting components, they enable the light-emitting device to be particularly compact, or they allow more LEDs to be provided in the same space. Thus a brighter illumination effect can be provided.

Although SMD LEDs can be applied by hand, it is expedient if they are applied solely by machine, so that the process can be automated. When applied by machine, the solder used is minimised and neat and contained within a well defined area. This enables the process to be quick and to be cost effective for high volume production.

SMD LEDs can also be placed very close to the battery entry point because there is no resin required that can cause problems with battery insertion or resin creep into the battery location area.

SMD LEDs also give the workers soldering the battery clips less of a problem because they are small and easier to avoid.

SMD LEDs also provide greater consistency from one LED to the next in terms of colour and light output. For example bonded white LEDs are produced by hand-doping blue LEDs with a phosphor. Doping by hand is subject to wide tolerances and often leads to inconsistencies in colour and light output.

A further advantage of using SMD LEDs is that the angle of light dispersion can be carefully controlled to maximise the contents illumination opportunities. Thus they provide improved options for consistency and range of choice.

The features of the various arrangements described may be substituted for each other or combined as desired. The embodiments of FIGS. 1 and 3 can be used to trigger any type of circuit 20, 120 and is not limited to being associated with light or sound emitting devices.

The features of the present disclosure may be submitted for or combined with, as appropriate, the features of co-pending international patent applications PCT/GB2010/002264 entitled "Sound-actuated Illumination Circuit" and PCT/GB2010/002265 entitled "Switch-Actuated Arrangements", both filed on even date.

The invention claimed is:

1. A battery powered switching arrangement powered by a battery for triggering operation of a device (130), comprising an integrated circuit (20, 120) having a trigger input and being configured, between triggering operations, to enter a standby state in which it draws minimal current from said battery, said arrangement further comprising a capacitor (C1) having an input and an output, and a switch member (SW1, 124, 100) for actuating said trigger input of the integrated circuit, wherein the switch member is connected in series with a high-ohmic resistive element (R1) with a resistance lying within the range of 2 to 8 megaohms, and wherein a junction between the switch member and the resistive element is connected to the input of the capacitor (C1), the output of the capacitor being connected to the input of the integrated circuit (20, 120), there being a direct functional relationship between the output of the capacitor and the input of the integrated circuit, and the arrangement being configured so that minimal current is drawn from said battery even when the switch member remains closed between switching operations.

2. A switching arrangement in accordance with claim 1, wherein the device (130) is a light or sound emitting device.

3. A switching arrangement according to claim 1, wherein the switch member is a user operated switch (SW1).

4. A switching arrangement according to claim 3, wherein the switch member is a tilt switch (100).

5. A switching arrangement according to claim 3, wherein the switch member is a slide switch or a tactile push switch.

6. A switching arrangement according to claim 1, wherein the switch member is selected from the group consisting of:

motion sensors, vibration sensors, temperature sensors, magnetic sensors, wireless sensors, light sensors, sound sensors, moisture sensors, proximity sensors and pressure sensors.

7. A switching arrangement according to claim 1, wherein the switch member is a comparator (124).

8. A switching arrangement according to claim 7, wherein an input of the comparator (124) is connected to the output of a vibration sensor (82).

9. A switching arrangement according to claim 8, wherein the vibration sensor (82) is a piezoelectric sensor.

10. A switching arrangement according to claim 1, wherein the device (130) comprises at least one LED device.

11. A switching arrangement according to claim 10, wherein the device (130) comprises at least one surface mount LED device.

12. A switching arrangement according to claim 1, wherein the capacitance of the capacitor (C1) lies within the range 5 to 20 nF.

13. A switching arrangement according to claim 1, wherein the resistance of the resistance element (R1) is 4.7 megaohms and the capacitance of the capacitor (C1) is 10 nF.

14. A switching arrangement in accordance with claim 1 comprising a battery having a battery nominal voltage and said integrated circuit having an integrated circuit nominal voltage, wherein the battery nominal voltage exceeds the integrated circuit nominal voltage.

15. A switching arrangement according to claim 8 and attached to a drinks bottle.

* * * * *